US008602340B2

(12) United States Patent
Berton

(10) Patent No.: US 8,602,340 B2
(45) Date of Patent: Dec. 10, 2013

(54) MILLING CONE FOR A COMPRESSION CRUSHER

(75) Inventor: Guy Berton, Oteppe (BE)

(73) Assignee: Magotteaux International S.A., Vaux-Sous-Chevremont (BE)

( * ) Notice: Subject to any disclaimer, the term of this patent is extended or adjusted under 35 U.S.C. 154(b) by 343 days.

(21) Appl. No.: 13/119,676

(22) PCT Filed: Aug. 26, 2009

(86) PCT No.: PCT/EP2009/060979

§ 371 (c)(1),
(2), (4) Date: May 31, 2011

(87) PCT Pub. No.: WO2010/031661

PCT Pub. Date: Mar. 25, 2010

(65) Prior Publication Data

US 2011/0303778 A1 Dec. 15, 2011

(30) Foreign Application Priority Data

Sep. 19, 2008 (BE) ..... 2008/0519

(51) Int. Cl.
*B02C 2/00* (2006.01)
*B22D 19/14* (2006.01)
*B22D 19/02* (2006.01)

(52) U.S. Cl.
USPC ..... 241/293; 164/91; 241/207

(58) Field of Classification Search
USPC ..... 241/207–216, 291, 293; 164/91
See application file for complete search history.

(56) References Cited

U.S. PATENT DOCUMENTS

| | | | |
|---|---|---|---|
| 5,081,774 | A | 1/1992 | Kuwano |
| 5,337,801 | A | 8/1994 | Materkowski |
| 5,516,053 | A | 5/1996 | Hannu |
| 5,720,830 | A | 2/1998 | Wragg et al. |
| 6,123,279 | A | 9/2000 | Stafford et al. |
| 2008/0041995 | A1 | 2/2008 | Hall et al. |

FOREIGN PATENT DOCUMENTS

| | | |
|---|---|---|
| EP | 1 450 973 B1 | 4/2006 |
| JP | 05317751 | 3/1993 |
| WO | WO 2007/138162 A1 | 12/2007 |

OTHER PUBLICATIONS

K. Das, A Review on the various synthesis routes of TiC reinforced ferrous based composites, online publication, 2002, 11 pages, pp. 3881-3892 , Journal of Materials Science 37 (2002) 3881-3892.

*Primary Examiner* — Mark Rosenbaum
(74) *Attorney, Agent, or Firm* — Reinhart Boerner Van Deuren P.C.

(57) ABSTRACT

The present invention discloses a composite milling cone for compression crushers, said milling cone comprising a ferrous alloy at least partially reinforced with titanium carbide according to a defined geometry, in which said reinforced portion comprises an alternating macro-microstructure of millimetric areas concentrated with micrometric globular particles of titanium carbide separated by millimetric areas (2) essentially free of micrometric globular particles of titanium carbide, said areas concentrated with micrometric globular particles of titanium carbide forming a microstructure in which the micrometric interstices between said globular particles are also filled by said ferrous alloy.

13 Claims, 6 Drawing Sheets

MILLING CONE FOR A COMPRESSION CRUSHER

FIELD OF THE INVENTION

The present invention relates to a composite milling cone for a compression crusher in the field of crushing rocks in extractive industries such as mines, quarries, cement works, etc., but also in the industry of recycling, etc., as well as to a method for manufacturing such cones.

DEFINITION

In this document, by compression crusher, we mean cone crushers or gyratory crushers equipped with milling cones forming the main wear part of these machines.

Cone crushers or gyratory crushers have a wear part in the shape of a cone, called a milling cone. This is the type of cone that the present patent application is about. The cone has the function of being in direct contact with the rock or the material to be milled during the phase of the process where very large compressive stresses are applied to the material to be crushed.

Compression crushers are used in the first steps of the manufacturing line intended to drastically reduce the size of the rock, in extractive industries (mines, quarries, cement works, . . . ) and recycling industries.

STATE OF THE ART

Few means are known for modifying the hardness and compression resistance of a foundry alloy in depth <<in the mass>>. Known means generally concern surface modifications at a small depth (a few millimeters). For parts which are made in foundries, the reinforcing elements have to be present in depth in order to withstand significant and simultaneous localized stresses in terms of mechanical stresses (wear, compression, impact) in order to limit wear and therefore consumption of the part during its lifetime.

Document U.S. Pat. No. 5,516,053 (Hannu) describes a method for improving the performances of milling cones for cone crushers, based on a reloading technique using hard particles such as tungsten carbide; this technique only produces its effects at the surface and over a relatively limited thickness.

Document JP 53 17731 proposes a solution which consists in alternating areas that are more resistant and less resistant to wear, in the direction of the generatrix of a milling cone. This technique has the effect of generating at the surface of the cone a relief which would be favorable to extending the lifetime of the part.

Document U.S. Pat. No. 6,123,279 (Stafford) proposes to reinforce the surfaces of the cones and jaws in manganese steel by means of tungsten carbide inserts which are introduced and mechanically set in housings provided for this purpose; this solution has the result of a discontinuous reinforcement of the surface of the part.

Document WO 2007/138162 (Hellman) describes a method for manufacturing a cone which resorts to composite materials.

Document US 2008/041995 (Hall) intends to reinforce the working surface of the cone with inserts in hard materials.

AIMS OF THE INVENTION

The present invention discloses a composite milling cone for compression crushers having an improved resistance to wear while maintaining a good resistance to impacts. This property is obtained by a composite reinforcement structure specifically designed for this application, a material which at a millimetric scale alternates areas which are dense with fine micrometric globular particles of metal carbides with areas which are practically free of them within the metal matrix of the milling cone.

The present invention also proposes a method for obtaining said reinforcement structure.

SUMMARY OF THE INVENTION

The present invention discloses a composite milling cone for compression crushers, said milling cone comprising a ferrous alloy reinforced at least partially with titanium carbide according to a defined geometry, in which said reinforced portion comprises an alternating macro-microstructure of millimetric areas concentrated with micrometric globular particles of titanium carbide separated by millimetric areas essentially free of micrometric globular particles of titanium carbide, said areas concentrated with micrometric globular particles of titanium carbide forming a microstructure in which the micrometric interstices between said globular particles are also filled by said ferrous alloy.

According to particular embodiments of the invention, the composite milling cone comprises at least one or one suitable combination of the following features:

- said concentrated millimetric areas have a titanium carbide concentration of more than 36.9% by volume;
- said reinforced portion has a global titanium carbide content between 16.6 and 50.5% by volume;
- the micrometric globular particles of titanium carbide have a size of less than 50 μm;
- the major portion of the micrometric globular particles of titanium carbide has a size of less than 20 μm;
- said areas concentrated with globular particles of titanium carbide comprise 36.9 to 72.2% by volume of titanium carbide;
- said millimetric areas concentrated with titanium carbide have a size varying from 1 to 12 mm;
- said millimetric areas concentrated with titanium carbide have a size varying from 1 to 6 mm;
- said areas concentrated with titanium carbide have a size varying from 1.4 to 4 mm.

The present invention also discloses a method for manufacturing the composite milling cone according to any of claims 1 to 9 comprising the following steps:

- providing a mold comprising the imprint of the milling cone with a predefined reinforcement geometry;
- introducing into the portion of the imprint of the milling cone intended to form the reinforced portion (5) a mixture of compacted powders comprising carbon and titanium in the form of millimetric granules precursor of titanium carbide;
- casting a ferrous alloy into the mold, the heat of said casting triggering an exothermic self-propagating high temperature synthesis (SHS) of titanium carbide within said precursor granules;
- forming, within the reinforced portion of the composite milling cone, an alternating macro-microstructure of millimetric areas concentrated with micrometric globular particles of titanium carbide at the location of said precursor granules, said areas being separated from each other by millimetric areas essentially free of micrometric globular particles of titanium carbide, said globular particles being also separated within said millimetric areas concentrated with titanium carbide through micrometric interstices;
- infiltration of the millimetric and micrometric interstices by said high temperature cast ferrous alloy, following the formation of microscopic globular particles of titanium carbide.

According to particular embodiments of the invention, the method comprises at least one or one suitable combination of the following features:

the compacted powders of titanium and carbon comprise a powder of a ferrous alloy;

said carbon is graphite.

The present invention also discloses a composite milling cone obtained according to the method of any of claims 11 to 13.

SHORT DESCRIPTION OF THE FIGURES

Figures 4A, 4B, 4C, 4D:
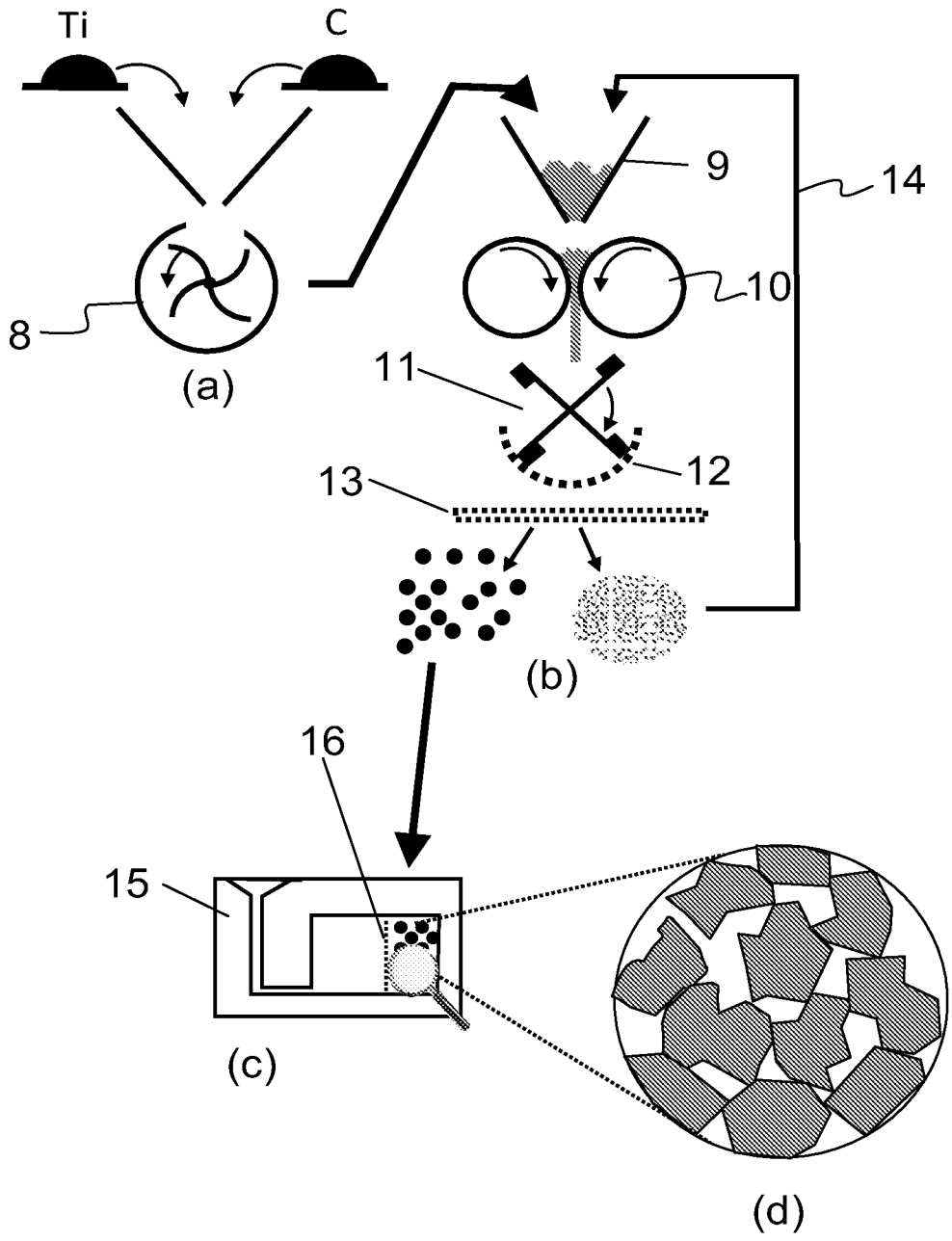
Figures 4E, 4F, 4G, 4H:
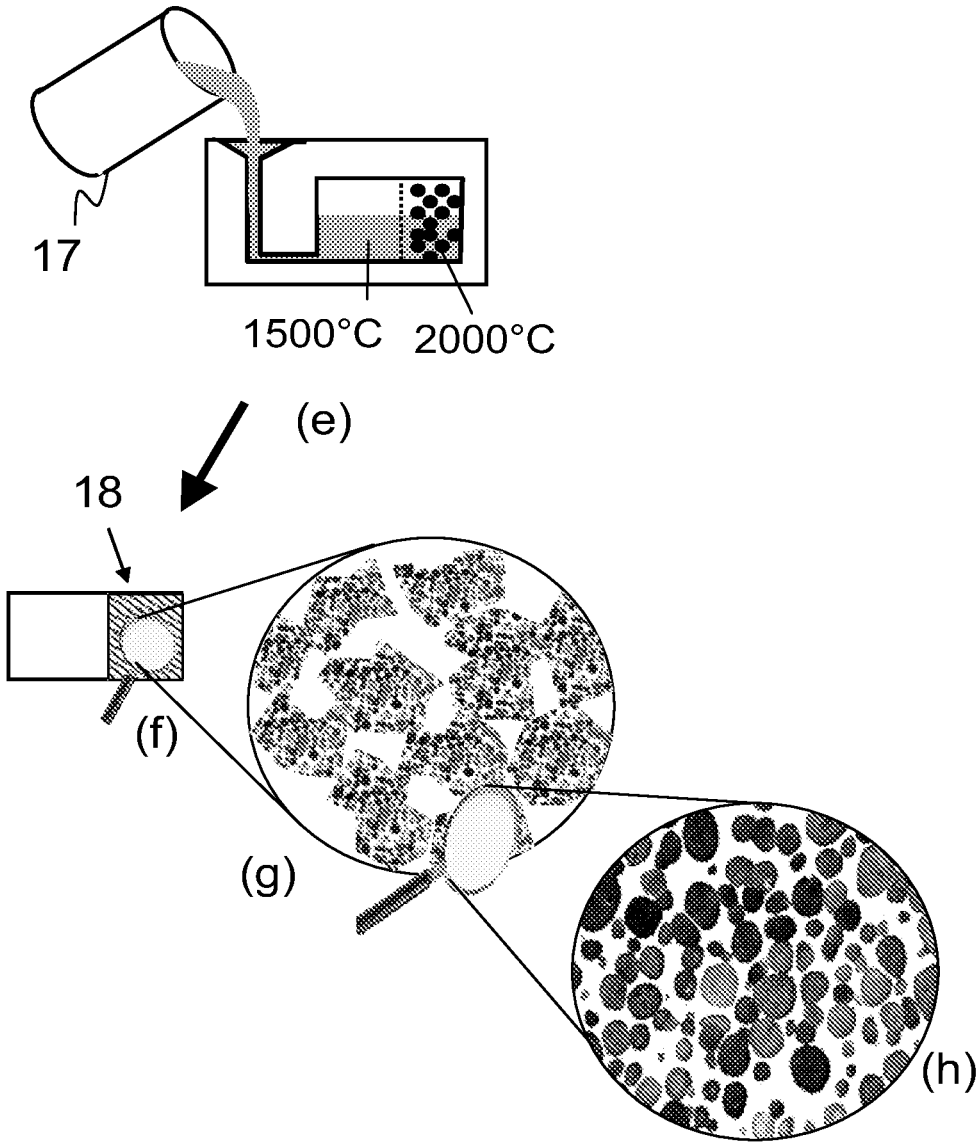

FIGS. 4*a*-4*h* schematically illustrate the method for manufacturing a cone according to the invention.

step 4*a* shows the device for mixing the titanium and carbon powders;

step 4*b* shows the compaction of the powders between two rolls followed by crushing and sifting with recycling of the too fine particles;

FIG. 4*c* shows a sand mold in which a barrier is placed for containing the granules of powder compacted at the location of the reinforcement of the lining bar for the jaw crusher;

FIG. 4*d* shows an enlargement of the reinforcement area in which the compacted granules comprising the reagents precursor of TiC are located;

step 4*e* shows the casting of the ferrous alloy into the mold;

FIG. 4*f* schematically shows a milling cone which is the result of the casting;

FIG. 4*g* shows an enlargement of the areas with a high concentration of TiC nodules;

FIG. 4*h* shows an enlargement within a same area with a high concentration of TiC nodules. The micrometric nodules are individually surrounded by the cast metal.

Figure 5:
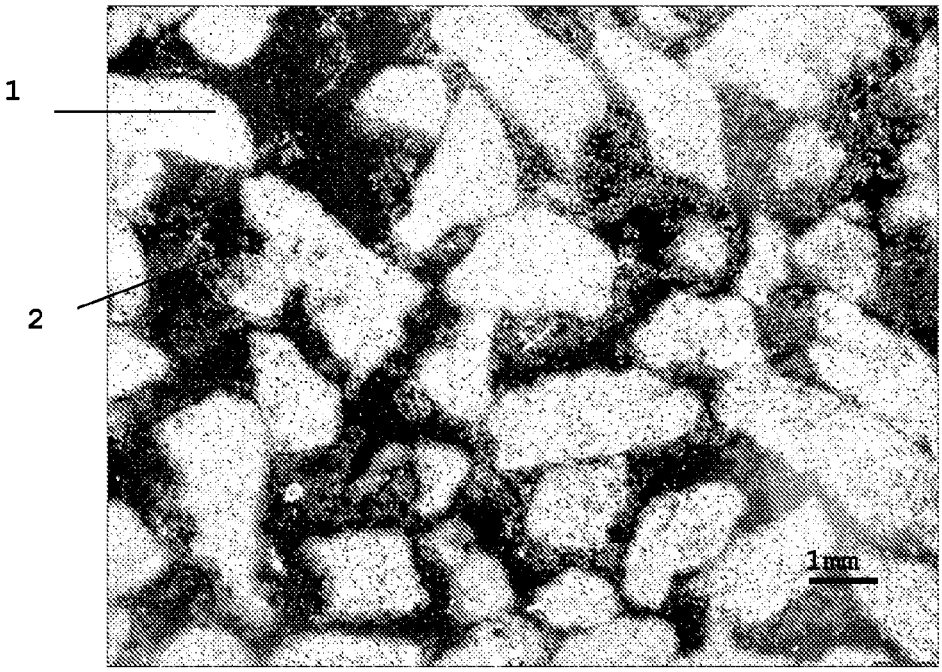

FIG. 5 illustrates a binocular view of a polished, non-etched surface of a section of the reinforced portion of a cone according to the invention with millimetric areas (in pale grey) concentrated with micrometric globular titanium carbide (TiC nodules). The dark portion illustrates the metal matrix (steel or cast iron) filling both the space between these areas concentrated with micrometric globular titanium carbide but also the spaces between the globules themselves.

Figure 6:
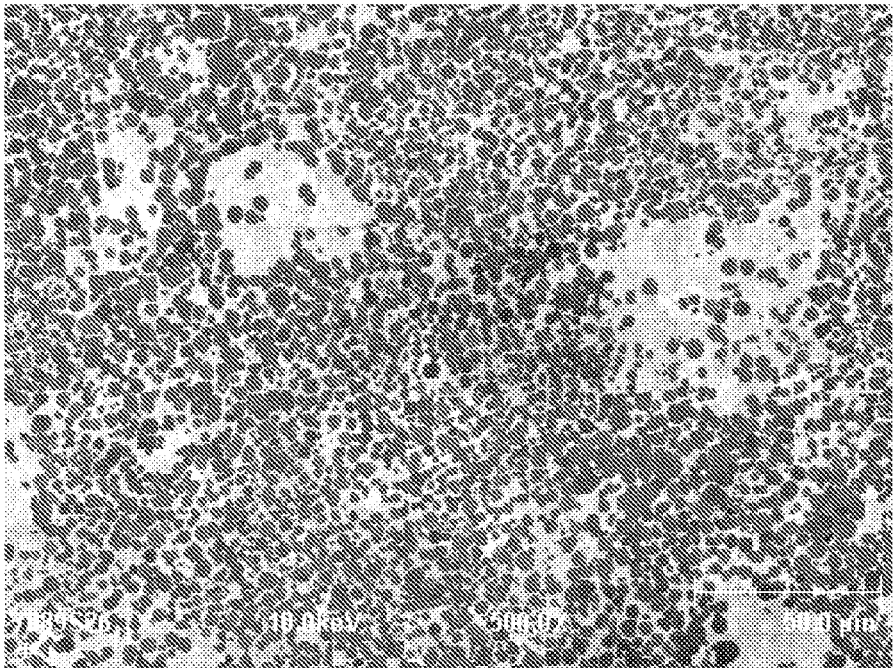
Figure 7:
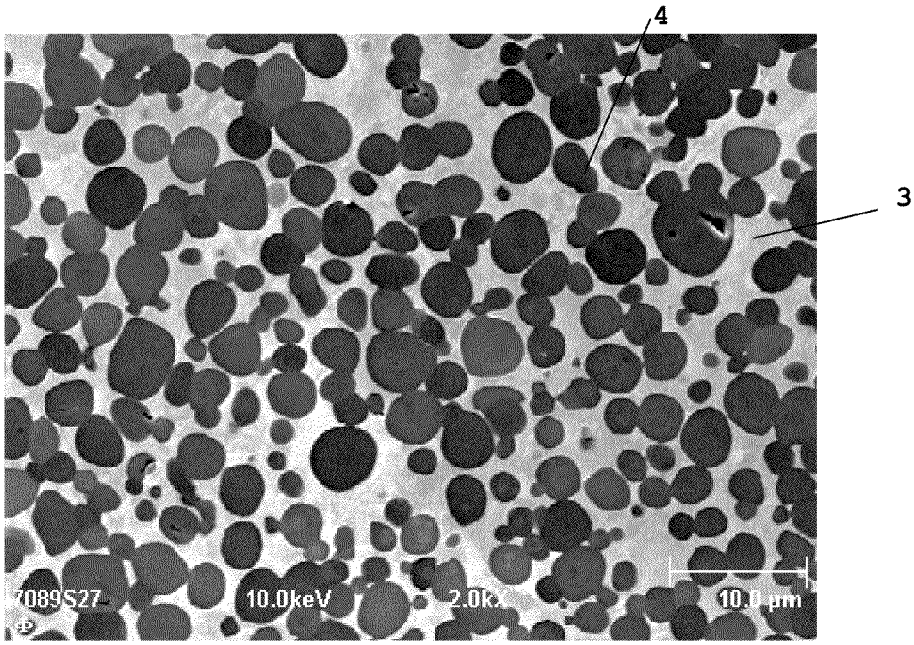

FIGS. 6 and 7 illustrate views taken with an SEM electron microscope of micrometric globular titanium carbide on polished and non-etched surfaces at different magnifications. It is seen that in this particular case, most of the titanium carbide globules have a size smaller than 10 μm.

Figure 8:
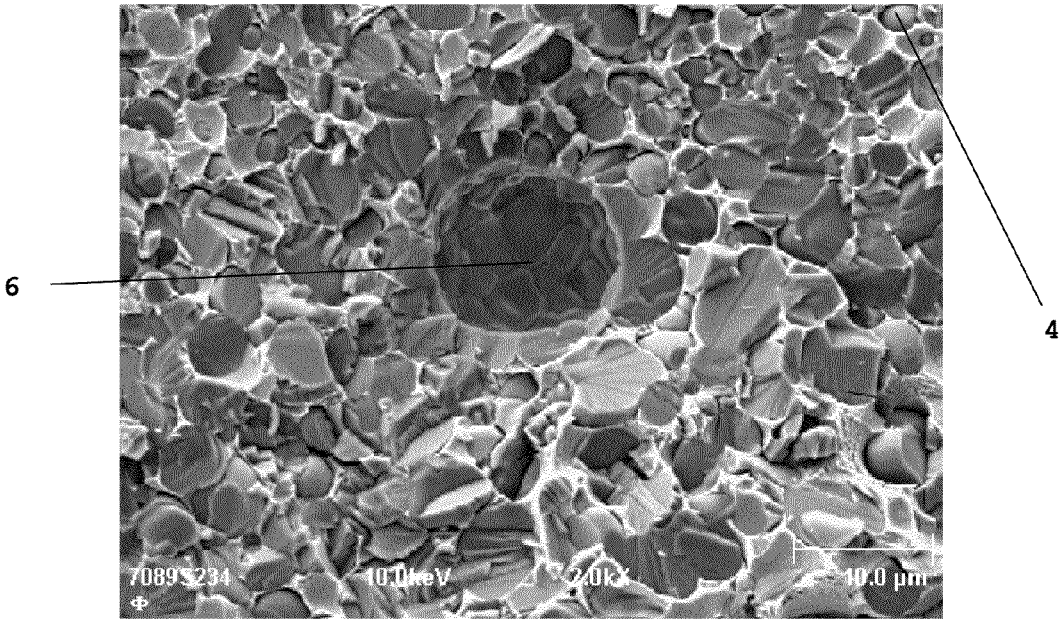

FIG. 8 illustrates a view of micrometric globular titanium carbide on a fracture surface taken with an SEM electron microscope. It is seen that the titanium carbide globules are perfectly incorporated into the metal matrix. This proves that the cast metal infiltrates (impregnates) completely the pores during the casting once the chemical reaction between titanium and carbon is initiated.

CAPTION

1. millimetric areas concentrated with micrometric globular particles of titanium carbide (nodules)

2. millimetric interstices filled with the cast alloy globally free of micrometric globular particles of titanium carbide

3. micrometric interstices between the TiC nodules also infiltrated by the cast alloy

4. micrometric globular titanium carbide, in areas concentrated with titanium carbide

5. titanium carbide reinforcement

6. gas defects

7. cone with reinforcement according to the invention

8. mixture of Ti and C powders

9. hopper

10. roll

11. grinding mill

12. outlet grid

13. sieve

14. recycling of the too fine particles towards the hopper

15. sand mold

16. barrier containing the compacted granules of a Ti/C mixture

17. cast ladle

18. cone (schematic)

DETAILED DESCRIPTION OF THE INVENTION

In materials science, a SHS reaction or <<Self-propagating High temperature Synthesis>> is a self-propagating high temperature synthesis where reaction temperatures generally above 1,500° C., or even 2,000° C. are reached. For example, the reaction between titanium powder and carbon powder in order to obtain titanium carbide TiC is strongly exothermic. Only a little energy is needed for locally initiating the reaction. Then, the reaction will spontaneously propagate to the totality of the mixture of the reagents by means of the high temperatures reached. After initiation of the reaction, a reaction front develops which thus propagates spontaneously (self-propagating) and which allows titanium carbide to be obtained from titanium and carbon. The thereby obtained titanium carbide is said to be <<obtained in situ>> because it does not stem from the cast ferrous alloy.

The mixtures of reagent powders comprise carbon powder and titanium powder and are compressed into plates and then crushed in order to obtain granules, the size of which varies from 1 to 12 mm, preferably from 1 to 6 mm, and more preferably from 1.4 to 4 mm. These granules are not 100% compacted. They are generally compressed to between 55 and 95% of the theoretical density. These granules allow an easy use/handling (see FIGS. 3*a*-3*h*).

These millimetric granules of mixed carbon and titanium powders obtained according to the diagrams of FIGS. 4*a*-4*h* are the precursors of the titanium carbide to be generated and allow portions of molds with various or irregular shapes to be easily filled. These granules may be maintained in place in the mold 15 by means of a barrier 16, for example. The shaping or the assembling of these granules may also be achieved with an adhesive.

The composite milling cone according to the present invention has a reinforcement macro-microstructure which may further be called an alternating structure of areas concentrated with globular micrometric particles of titanium carbide separated by areas which are practically free of them. Such a structure is obtained by a reaction in the mold 15 of the granules comprising a mixture of carbon and titanium powders. This reaction is initiated by the casting heat of the cast iron or the steel used for casting the whole part and therefore both the non-reinforced portion and the reinforced portion (see FIG. 3*e*). Casting therefore triggers an exothermic self-propagating high temperature synthesis of the mixture of carbon and titanium powders compacted as granules (self-propagating high temperature synthesis—SHS) and placed beforehand in the mold 15. The reaction then has the particularity of continuing to propagate as soon as it is initiated.

This high temperature synthesis (SHS) allows an easy infiltration of all the millimetric and micrometric interstices by the cast iron or cast steel (FIGS. 4*g* and 4*h*). By increasing the wettability, the infiltration may be achieved over any reinforcement thickness or depth of the milling cone. After SHS reaction and an infiltration by an outer cast metal, it advantageously allows to generate one or more reinforcing areas on the milling cone comprising a high concentration of micrometric globular particles of titanium carbide (which may further be called clusters of nodules), said areas having a size of the order of one millimeter or of a few millimeters, and which alternate with areas substantially free of globular titanium carbide.

Once these granules have reacted according to an SHS reaction, the reinforcement areas where these granules were located show a concentrated dispersion of micrometric globular particles 4 of TiC carbide (globules), the micrometric interstices 3 of which have also been infiltrated by the cast metal which here is cast iron or steel. It is important to note that the millimetric and micrometric interstices are infiltrated by the same metal matrix as the one which forms the non-reinforced portion of the milling cone; this allows total freedom in the selection of the cast metal. In the finally obtained milling cone, the reinforcement areas with a high concentration of titanium carbide consist of micrometric globular TiC particles in a significant percentage (between about 35 and about 70% by volume) and of the infiltration ferrous alloy.

By micrometric globular particles it is meant globally spheroidal particles which have a size ranging from 1 μm to a few tens of μm at the very most, the large majority of these particles having a size of less than 50 μm, and even less than 20 μm, or even 10 μm. We also call them TiC globules. This globular shape is characteristic of a method for obtaining titanium carbide by self-propagating synthesis SHS (see FIG. 7).

Obtaining Granules (Ti+C Version) for Reinforcing the Milling Cone

The method for obtaining the granules is illustrated in FIG. 4*a*-4*h*. The granules of carbon/titanium reagents are obtained by compaction between rolls 10 in order to obtain strips which are then crushed in a crusher 11. The mixing of the powders is carried out in a mixer 8 consisting of a tank provided with blades, in order to favor homogeneity. The mixture then passes into a granulation apparatus through a hopper 9. This machine comprises two rolls 10, through which the material is passed. Pressure is applied on these rolls 10, which allows the compression of the material. At the outlet a strip of compressed material is obtained which is then crushed in order to obtain the granules. These granules are then sifted to the desired grain size in a sieve 13. A significant parameter is the pressure applied on the rolls. The higher this pressure, the more the strip, and therefore the granules, will be compressed. The density of the strips, and therefore of the granules, may thus be varied between 55 and 95% of the theoretical density which is 3.75 g/cm$^3$ for the stoichiometric mixture of titanium and carbon. The apparent density (taking into account porosity) is then located between 2.06 and 3.56 g/cm$^3$.

The compaction level of the strips depends on the applied pressure (in Pa) on the rolls (diameter 200 mm, width 30 mm). For a low compaction level, of the order of $10^6$ Pa, a density on the strips of the order of 55% of the theoretical density is obtained. After passing through the rolls 10 in order to compress this material, the apparent density of the granules is 3.75×0.55, i.e. 2.06 g/cm$^3$.

For a high compaction level, of the order of $25.10^6$ Pa, a density on the strips of 90% of the theoretical density is obtained, i.e. an apparent density of 3.38 g/cm$^3$. In practice, it is possible to attain up to 95% of the theoretical density.

Therefore, the granules obtained from the raw material Ti+C are porous. This porosity varies from 5% for very highly compressed granules to 45% for slightly compressed granules.

In addition to the compaction level, it is also possible to adjust the grain size distribution of the granules as well as their shape during the operation of crushing the strips and sifting the Ti+C granules. The non-desired grain size fractions are recycled at will (see FIG. 4*b*). The obtained granules globally have a size between 1 and 12 mm, preferably between 1 and 6 mm, and more preferably between 1.4 and 4 mm.

Making of the Reinforcement Area in the Composite Milling Cone According to the Invention The granules are made as described above. In order to obtain a three-dimensional structure or a superstructure/macro-microstructure with these granules, they are positioned in the areas of the mold where it is desired to reinforce the part. This is achieved by agglomerating the granules either by means of an adhesive, or by confining them in a container or by any other means (barrier 16).

The bulk density of the stack of the Ti+C granules is measured according to the ISO 697 standard and depends on the compaction level of the strips, on the grain size distribution of the granules and on the method for crushing the strips, which influences the shape of the granules. The bulk density of these Ti+C granules is generally of the order of 0.9 g/cm$^3$ to 2.5 g/cm$^3$ depending on the compaction level of these granules and on the density of the stack.

Before reaction, there is therefore a stack of porous granules consisting of a mixture of titanium powder and carbon powder.

During the reaction Ti+C→TiC, a volume contraction of the order of 24% occurs, upon passing from the reagents to the product (a contraction originating from the density difference between the reagents and the products). Thus, the theoretical density of the Ti+C mixture is 3.75 g/cm$^3$ and the theoretical density of TiC is 4.93 g/cm$^3$. In the final product, after the reaction for obtaining TiC, the cast metal will infiltrate:

- the microscopic porosity present in the spaces with a high titanium carbide concentration, depending on the initial compaction level of these granules;
- the millimetric spaces between the areas with a high titanium carbide concentration, depending on the initial stack of the granules (bulk density);
- the porosity originating from the volume contraction during the reaction between Ti+C for obtaining TiC.

EXAMPLES

In the examples which follow, the following raw materials were used:

- titanium H. C. STARCK, Amperit 155.066, less than 200 mesh,
- graphite carbon GK Kropfmuhl, UF4, >99.5%, less than 15 μm,
- Fe, in the form of HSS M2 Steel, less than 25 μm,
- proportions:
  - Ti+C 100 g Ti−24.5 g C
  - Ti+C+Fe 100 g Ti−24.5 g C−35.2 g Fe Mixing for 15 min in a Lindor mixer, under argon.

The granulation was carried out with a Sahut-Conreur granulator.

For the Ti+C+Fe and Ti+C mixtures, the compactness of the granules was obtained by varying the pressure between the rolls from 10 to $250.10^5$ Pa.

The reinforcement was carried out by placing granules in a metal container, which is then judiciously placed in the mold at the location where the milling cone is likely to be reinforced. Then, the steel or the cast iron is cast into the mold.

Example 1

In this example, the aim is to make a milling cone, the reinforced areas of which comprise a global volume percentage of TiC of about 42%. For this purpose, a strip is made by compaction to 85% of the theoretical density of a mixture of C and of Ti. After crushing, the granules are sifted so as to obtain a dimension of granules located between 1.4 and 4 mm. A bulk density of the order of 2.1 g/cm$^3$ is obtained (35% of space between the granules+15% of porosity in the granules).

The granules are positioned in the mold at the location of the portion to be reinforced which thus comprises 65% by volume of porous granules. A cast iron with chromium (3% C, 25% Cr) is then cast at about 1500° C. in a non-preheated sand mold. The reaction between the Ti and the C is initiated by the heat of the cast iron. This casting is carried out without any protective atmosphere. After reaction, in the reinforced portion, 65% by volume of areas with a high concentration of about 65% of globular titanium carbide are obtained, i.e. 42% by the global volume of TiC in the reinforced portion of the milling cone.

Example 2

In this example, the aim is to make a milling cone, the reinforced areas of which comprise a global volume percentage of TiC of about 30%. For this purpose, a strip is made by compaction to 70% of the theoretical density of a mixture of C and of Ti. After crushing, the granules are sifted so as to obtain a dimension of granules located between 1.4 and 4 mm. A bulk density of the order of 1.4 g/cm$^3$ is obtained (45% of space between the granules+30% of porosity in the granules). The granules are positioned in the portion to be reinforced which thus comprises 55% by volume of porous granules. After reaction, in the reinforced portion, 55% by volume of areas with a high concentration of about 53% of globular titanium carbide are obtained, i.e. about 30% by the global volume of TiC in the reinforced portion of the milling cone.

Example 3

In this example, the aim is to make a milling cone, the reinforced areas of which comprise a global volume percentage of TiC of about 20%. For this purpose, a strip is made by compaction to 60% of the theoretical density of a mixture of C and of Ti. After crushing, the granules are sifted so as to obtain a dimension of granules located between and 6 mm. A bulk density of the order of 1.0 g/cm$^3$ is obtained (55% of space between the granules +40% of porosity in the granules). The granules are positioned in the portion to be reinforced which thus comprises 45% by volume of porous granules. After reaction, in the reinforced portion, 45% by volume of areas concentrated to about 45% of globular titanium carbide are obtained, i.e. 20% by the global volume of TiC in the reinforced portion of the milling cone.

Example 4

In this example, it was sought to attenuate the intensity of the reaction between the carbon and the titanium by adding a ferrous alloy as a powder therein. Like in Example 2, the aim is to make a milling cone, the reinforced areas of which comprise a global volume percentage of TiC of about 30%. For this purpose, a strip is made by compaction to 85% of the theoretical density of a mixture of 15% C, 63% Ti and 22% Fe by weight. After crushing, the granules are sifted so as to attain a dimension of granules located between 1.4 and 4 mm. A bulk density of the order of 2 g/cm$^3$ is obtained (45% of space between the granules +15% of porosity in the granules). The granules are positioned in the portion to be reinforced which thus comprises 55% by volume of porous granules. After reaction, in the reinforced portion, 55% by volume of areas with a high concentration of about 55% of globular titanium carbide are obtained, i.e. 30% by volume of the global titanium carbide in the reinforced macro-microstructure of the milling cone.

The following tables show the numerous possible combinations.

TABLE 1

(Ti + 0.98C)
Global percentage of TiC obtained in the reinforced macro-microstructure after reaction of Ti + 0.98C in the reinforced portion of the milling cone.

| | | Compaction of the granules (% of the theoretical density which is 3.75 g/cm$^3$) | | | | | | | | |
|---|---|---|---|---|---|---|---|---|---|---|
| | | 55 | 60 | 65 | 70 | 75 | 80 | 85 | 90 | 95 |
| Filling of the reinforced portion of the part (% by volume) | **70** | 29.3 | 31.9 | 34.6 | 37.2 | 39.9 | 42.6 | 45.2 | 47.9 | 50.5 |
| | **65** | 27.2 | **29.6** | 32.1 | 34.6 | 37.1 | 39.5 | 42.0 | 44.5 | 46.9 |
| | **55** | 23.0 | 25.1 | 27.2 | **29.3** | 31.4 | 33.4 | 35.5 | 37.6 | 39.7 |
| | **45** | 18.8 | 20.5 | 22.2 | 23.9 | 25.7 | 27.4 | **29.1** | 30.8 | 32.5 |

This table shows that with a compaction level ranging from 55 to 95% for the strips and therefore the granules, it is possible to perform granule filling levels in the reinforced portion of the milling cone ranging from 45% to 70% by volume (ratio between the total volume of the granules and the volume of their confinement). Thus, in order to obtain a global TiC concentration in the reinforced portion of about 29% by volume (in bold characters in the table), it is possible to proceed with different combinations such as for example 60% compaction and 65% filling, or 70% compaction and 55% filling, or further 85% compaction and 45% filling. In order to obtain granule filling levels in the reinforced portion ranging up to 70% by volume, it is mandatory to apply a vibration in order to pack the granules. In this case, the ISO 697 standard for measuring the filling level is no longer applicable and the amount of material in a given volume is measured.

TABLE 2

Relationship between the compaction level, the theoretical density and the TiC percentage obtained after reaction in the granule.

| | Compaction of the granules | | | | | | | | |
|---|---|---|---|---|---|---|---|---|---|
| | 55 | 60 | 65 | 70 | 75 | 80 | 85 | 90 | 95 |
| Density in g/cm$^3$ | 2.06 | 2.25 | 2.44 | 2.63 | 2.81 | 3.00 | 3.19 | 3.38 | 3.56 |
| TiC obtained after reaction (and contraction) in volume % in the granules | 41.8 | 45.6 | 49.4 | 53.2 | 57.0 | 60.8 | 64.6 | 68.4 | 72.2 |

Here, we have represented the density of the granules according to their compaction level and the volume percent of TiC obtained after reaction and therefore contraction of about 24% by volume was inferred therefrom. Granules compacted to 95% of their theoretical density therefore allow to obtain after reaction a concentration of 72.2% by volume of TiC.

TABLE 3

Bulk density of the stack of granules

| | | Compaction | | | | | | | | |
|---|---|---|---|---|---|---|---|---|---|---|
| | | 55 | 60 | 65 | 70 | 75 | 80 | 85 | 90 | 95 |
| Filling of the reinforced portion of the part in volume % | 70 | 1.4 | 1.6 | 1.7 | 1.8 | 2 | 2.1 | 2.2 | 2.4 | 2.5 |
| | 65 | 1.3* | 1.5 | 1.6 | 1.7 | 1.8 | 2.0 | 2.1 | 2.2 | 2.3 |
| | 55 | 1.1 | 1.2 | 1.3 | 1.4 | 1.5 | 1.7 | 1.8 | 1.9 | 2.0 |
| | 45 | 0.9 | 1.0 | 1.1 | 1.2 | 1.3 | 1.4 | 1.4 | 1.5 | 1.6 |

*Bulk density (1.3) = theoretical density (3.75 g/cm$^3$) × 0.65 (filling) × 0.55 (compaction)

In practice, these tables are used as abacuses by the user of this technology, who sets a global TiC percentage to be obtained in the reinforced portion of the milling cone and who, depending on this, determines the filling level and the compaction of the granules which he/she will use. The same tables were produced for a mixture of Ti+C+Fe powders.

Ti+0.98 C+Fe

Here, the inventor aimed at a mixture allowing to obtain 15% by volume of iron after reaction. The mixture proportion which was used is:

100 g Ti+24.5 g C+35.2 g Fe

By iron powder it is meant: pure iron or an iron alloy.

Theoretical density of the mixture: 4.25 g/cm$^3$

Volume shrinkage during the reaction: 21%

TABLE 4

Global TiC percentage obtained in the reinforced macro-microstructure after reaction of Ti + 0.98C + Fe in the reinforced portion of the milling cone.

| | | Compaction of the granules (% of the theoretical density which is 4.25 g/cm$^3$) | | | | | | | | |
|---|---|---|---|---|---|---|---|---|---|---|
| | | 55 | 60 | 65 | 70 | 75 | 80 | 85 | 90 | 95 |
| Filling of the reinforced portion of the part (vol. %) | **70** | **25.9** | 28.2 | 30.6 | 32.9 | 35.5 | 37.6 | 40.0 | 42.3 | 44.7 |
| | **65** | 24.0 | **26.2** | 28.4 | 30.6 | 32.7 | 34.9 | 37.1 | 39.3 | 41.5 |
| | **55** | 20.3 | 22.2 | 24.0 | **25.9** | 27.7 | 29.5 | 31.4 | 33.2 | 35.1 |
| | **45** | 16.6 | 18.1 | 19.6 | 21.2 | 22.7 | 24.2 | **25.7** | 27.2 | 28.7 |

Again, in order to obtain a global TiC concentration in the reinforced portion of about 26% by volume (in bold characters in the table), it is possible to proceed with different combinations such as for example 55% compaction and 70% filling, or 60% compaction and 65% filling, or 70% compaction and 55% filling, or further 85% compaction and 45% filling.

TABLE 5

Relationship between the compaction level, the theoretical density and the TiC percentage, obtained after reaction in the granule while taking into account the presence of iron.

| | Compaction of the granules | | | | | | | | |
|---|---|---|---|---|---|---|---|---|---|
| | 55 | 60 | 65 | 70 | 75 | 80 | 85 | 90 | 95 |
| Density in g/cm$^3$ | 2.34 | 2.55 | 2.76 | 2.98 | 3.19 | 3.40 | 3.61 | 3.83 | 4.04 |
| TiC obtained after reaction (and contraction) in vol. % in the granules | 36.9 | 40.3 | 43.6 | 47.0 | 50.4 | 53.7 | 57.1 | 60.4 | 63.8 |

TABLE 6

| Bulk density of the stack of (Ti + C + Fe) granules | | | | | | | | | | |
|---|---|---|---|---|---|---|---|---|---|---|
| | | Compaction | | | | | | | | |
| | | 55 | 60 | 65 | 70 | 75 | 80 | 85 | 90 | 95 |
| Filling of the reinforced portion of the part in vol. % | 70 | 1.6 | 1.8 | 1.9 | 2.1 | 2.2 | 2.4 | 2.5 | 2.7 | 2.8 |
| | 65 | 1.5* | 1.7 | 1.8 | 1.9 | 2.1 | 2.2 | 2.3 | 2.5 | 2.6 |
| | 55 | 1.3 | 1.4 | 1.5 | 1.6 | 1.8 | 1.9 | 2.0 | 2.1 | 2.2 |
| | 45 | 1.1 | 1.1 | 1.2 | 1.3 | 1.4 | 1.5 | 1.6 | 1.7 | 1.8 |

*Bulk density (1.5) = theoretical density (4.25) × 0.65 (filling) × 0.55 (compaction)

Advantages

The present invention has the following advantages in comparison with the state of the art in general:

Better Resistance to Impacts

With the present method, porous millimetric granules are obtained which are embedded into the infiltration metal alloy. These millimetric granules themselves consist of microscopic particles of TiC with a globular tendency also embedded into the infiltration metal alloy. This system allows to obtain a milling cone with a reinforcement area comprising a macrostructure within which there is an identical microstructure at a scale which is about a thousand times smaller.

The fact that the reinforcement area of the milling cone comprises small hard globular particles of titanium carbide finely dispersed in a metal matrix surrounding them allows to avoid the formation and propagation of cracks (see FIGS. 4 and 6). One has thus a double dissipative system for cracks.

The cracks generally originate at the most brittle locations, which in this case are the TiC particle or the interface between this particle and the infiltration metal alloy. If a crack originates at the interface or in the micrometric TiC particle, the propagation of this crack is then hindered by the infiltration alloy which surrounds this particle. The toughness of the infiltration alloy is greater than that of the ceramic TiC particle. The crack needs more energy for passing from one particle to another, for crossing the micrometric spaces which exist between the particles.

Maximum Flexibility for the Application Parameters

In addition to the compaction level of the granules, two parameters may be varied, which are the grain size fraction and the shape of the granules, and therefore their bulk density. On the other hand, in a reinforcement technique with inserts, only the compaction level of the latter can be varied within a limited range. As regards the desired shape to be given to the reinforcement, taking into account the design of the milling cone and the location where reinforcement is desired, the use of granules allows further possibilities and adaptation. (see FIG. 3).

Advantages as Regards Manufacturing

The use of a stack of porous granules as a reinforcement has certain advantages as regards manufacturing:

less gas emission, less sensitivity to crack, better localization of the reinforcement in the milling cone.

The reaction between Ti and C is strongly exothermic. The rise in temperature causes degassing of the reagents, i.e. volatile materials comprised in the reagents ($H_2O$ in carbon, $H_2$, $N_2$ in titanium). The higher the reaction temperature, the more significant is this emission. The granule technique allows to limit the temperature, to limit the gas volume and to more easily discharge the gases and thus limit the gas defects. (see FIG. 9 with an undesirable gas bubble).

Low Sensitivity to Crack During the Manufacturing of the Milling Cone According to the Invention The expansion coefficient of the TiC reinforcement is lower than that of the ferrous alloy matrix (expansion coefficient of TiC: 7.5 $10^{-6}$/K and of the ferrous alloy: about 12.0 $10^{-6}$/K). This difference in expansion coefficients has the consequence of generating stresses in the material during the solidification phase and also during the heat treatment. If these stresses are too significant, cracks may appear in the part and lead to its reject. In the present invention a small proportion of TiC reinforcement is used (less than 50% by volume), which causes less stresses in the part. Further, the presence of a more ductile matrix between the micrometric globular TiC particles in the alternating areas of low and high concentration allows to better handle possible local stresses.

Excellent Maintenance of the Reinforcement in the Milling Cone

In the present invention, the frontier between the reinforced portion and the non-reinforced portion of the milling cone is not abrupt since there is a continuity of the metal matrix between the reinforced portion and the non-reinforced portion, which allows to protect it against a complete detachment of the reinforcement.

Test Results

Figure 1:
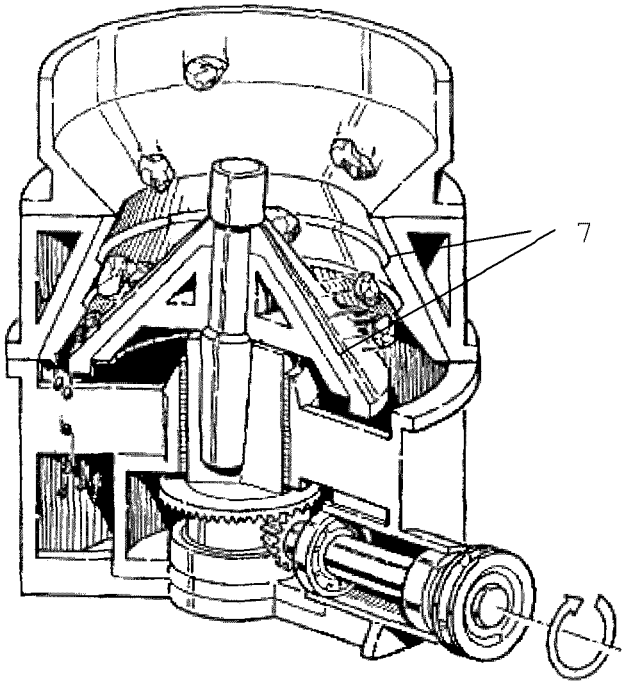
FIGS. 1 and 2 show a global three-dimensional view of the different types of machines in which milling cones according to the present invention are used.
Figure 2:
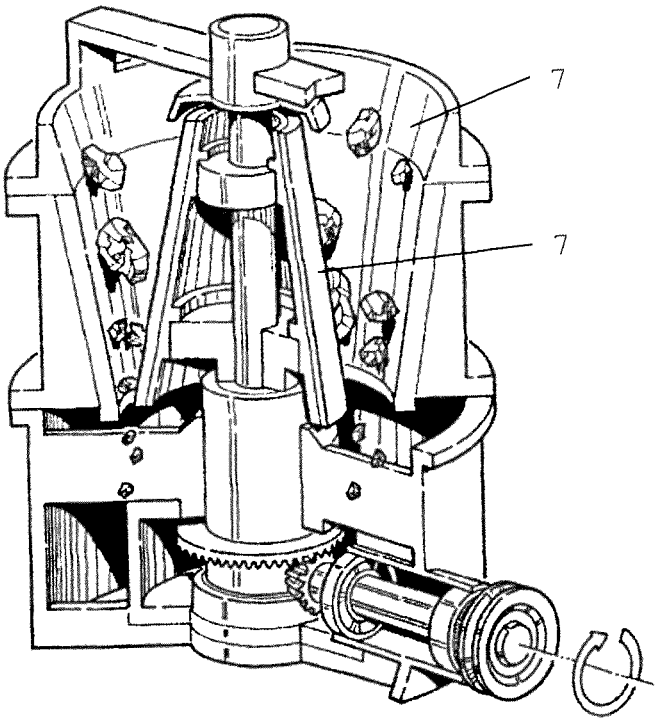
Figure 3:
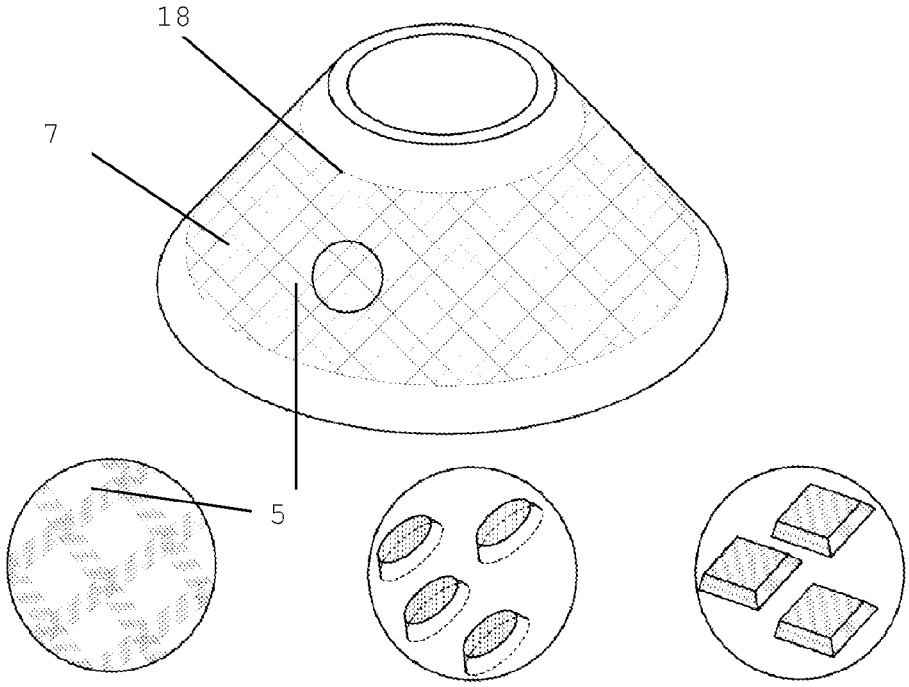
FIG. 3 shows a three-dimensional view of a milling cone and how the reinforcement(s) may be positioned so as to achieve the sought purpose (reinforcement geometry).

Three tests were carried out with cones of the type of the one illustrated in FIG. 3.

Test 1 secondary crusher crushed material: aggregates, high abrasivity increase in the lifetime of the reinforced cone as compared with a cone in manganese steel: 50%

Test 2 secondary crusher crushed material: aggregates, medium abrasivity increase in the lifetime of the reinforced cone as compared with a cone in manganese steel: 130%

Test 3 secondary crusher crushed material: aggregates, medium abrasivity increase in the lifetime of the reinforced cone as compared with a cone in manganese steel: 170%.

The invention claimed is:

1. A composite milling cone for compression crushers, said milling cone comprising a ferrous alloy at least partially reinforced (5) with titanium carbide according to a defined geometry, wherein said reinforced portion (5) comprises an alternating macro-microstructure of millimetric areas (1) concentrated with micrometric globular particles of titanium carbide (4) separated by millimetric areas (2) essentially free of micrometric globular particles of titanium carbide (4), said areas concentrated with micrometric globular particles of titanium carbide (4) forming a microstructure in which the micrometric interstices (3) between said globular particles (4) are also filled by said ferrous alloy.

2. The milling cone according to claim 1, wherein said millimetric concentrated areas have a concentration of micrometric globular particles of titanium carbide (4) greater than 36.9% by volume.

3. The milling cone according to claim 1, wherein said reinforced portion has a global titanium carbide content between 16.6 and 50.5% by volume.

4. The milling cone according to claim 1, wherein the micrometric globular particles of titanium carbide (4) have a size of less than 50 μm.

5. The milling cone according to claim 1, wherein the major portion of the micrometric globular particles of titanium carbide (4) has a size of less than 20 μm.

6. The milling cone according to claim 1, wherein said areas concentrated with globular particles of titanium carbide (1) comprise 36.9 to 72.2% by volume of titanium carbide.

7. The milling cone according to claim 1, wherein said areas concentrated with titanium carbide (1) have a dimension varying from 1 to 12 mm.

8. The milling cone according to claim 1, wherein said areas concentrated in titanium carbide (1) have a dimension varying from 1 to 6 mm.

9. The milling cone according to claim 1, wherein said areas concentrated in titanium carbide (1) have a dimension varying from 1.4 to 4 mm.

10. A method for manufacturing by casting a composite milling cone according to claim 1, comprising the following steps:

providing a mold comprising the imprint of the milling cone with a predefined reinforcement geometry;

introducing, into the portion of the imprint of the milling cone intended to form the reinforced portion (5), a mixture of compacted powders comprising carbon and titanium in the form of millimetric granules precursor of titanium carbide;

casting a ferrous alloy into the mold, the heat of said casting triggering an exothermic self-propagating high temperature synthesis (SHS) of titanium carbide within said precursor granules;

forming, within the reinforced portion (5) of the milling cone, an alternating macro-microstructure of millimetric areas concentrated (1) with micrometric globular particles of titanium carbide (4) at the location of said precursor granules, said areas being separated from each other by millimetric areas (2) essentially free of micrometric globular particles of titanium carbide (4), said globular particles (4) being also separated within said millimetric areas concentrated (1) with titanium carbide by micrometric interstices (3);

infiltration of the millimetric (2) and micrometric (3) interstices by said high temperature cast ferrous alloy, following the formation of microscopic globular particles of titanium carbide (4).

11. The manufacturing method according to claim 10, wherein the mixture of compacted powders of titanium and carbon comprises a powder of a ferrous alloy.

12. The manufacturing method according to claim 10, wherein said carbon is graphite.

13. The milling cone obtained according to claim 10.

* * * * *